US005609335A

United States Patent [19]

Parker

[11] Patent Number: 5,609,335

[45] Date of Patent: Mar. 11, 1997

[54] HIGH CAPACITY STACKER/SEPARATING DEVICE

[75] Inventor: Rebecca L. Parker, Grand Island, N.Y.

[73] Assignee: Moore Business Forms, Inc., Grand Island, N.Y.

[21] Appl. No.: 480,861

[22] Filed: Jun. 7, 1995

[51] Int. Cl.[6] ..... B65H 39/10

[52] U.S. Cl. ..... 271/302; 198/462.2; 198/418.8; 271/270; 271/176; 271/216; 271/200

[58] Field of Search ..... 271/184, 272, 271/274, 270, 176, 266, 258.04, 258.01, 46, 302, 198, 200; 198/462.2, 418.8

[56] References Cited

U.S. PATENT DOCUMENTS

| | | | |
|---|---|---|---|
| 1,562,271 | 11/1925 | Aldrich . | |
| 2,133,260 | 10/1938 | Wolff | 271/216 |
| 2,392,746 | 1/1946 | Laborbarde | 271/216 |
| 3,191,929 | 6/1965 | Zernov et al. . | |
| 3,248,106 | 4/1966 | Fry . | |
| 3,401,930 | 9/1968 | Bishop . | |
| 3,519,267 | 7/1970 | Miller | 271/116 |
| 3,765,591 | 9/1973 | Müller . | |
| 3,842,719 | 10/1974 | Fernandez-Rana et al. | 271/216 |
| 3,861,515 | 1/1975 | Runyan et al. . | |
| 4,051,779 | 10/1977 | Zaagman . | |
| 4,241,910 | 12/1980 | Matsuo . | |
| 4,486,014 | 12/1984 | Enoguchi et al. . | |
| 4,805,890 | 2/1989 | Martin . | |
| 4,830,356 | 5/1989 | Zoltner . | |
| 4,953,843 | 9/1990 | Reist . | |
| 5,004,220 | 4/1991 | Dreschel et al. . | |
| 5,054,769 | 10/1991 | Watashi . | |
| 5,082,273 | 1/1992 | Matsumoto et al. . | |
| 5,101,241 | 3/1992 | Watanabe . | |
| 5,169,138 | 12/1992 | Cordes | 271/184 |
| 5,238,164 | 8/1993 | Freeman . | |
| 5,265,731 | 11/1993 | Van de Ven . | |
| 5,409,207 | 4/1995 | Freeman . | |

FOREIGN PATENT DOCUMENTS

| | | | |
|---|---|---|---|
| 1217234 | 5/1960 | France | 198/418.8 |
| 2107679 | 5/1983 | United Kingdom | 271/272 |

*Primary Examiner*—H. Grant Skaggs
*Attorney, Agent, or Firm*—Nixon & Vanderhye P.C.

[57] ABSTRACT

A high capacity conveyor assembly is utilizable with pressure sealers or other business forms manufacturing or handling equipment to efficiently handle forms that may be job separated, and provides high capacity outfeed. An infeed conveyor has a first horizontal conveyance surface and feeds forms in a first direction to a pair of nip wheels, with an outfeed conveyor downstream of the wheels for also feeding forms in the first direction and having a second horizontal conveyance surface. The nip wheels are powered and include a top nip wheel and a bottom nip wheel with a nip between them, the bottom nip wheel having a top peripheral surface closer to the outfeed conveyor than is the nip. A transition element (such as a low friction shelf) has a form supporting surface lower than the bottom nip wheel top peripheral surface, and is between the nip wheels and outfeed conveyor. A sensor senses build up of forms on the transition element and through a controller controls operation of the outfeed conveyor (which preferably is a pair of rollers with a number of conveyor tapes or belts wrapped around them) to at spaced time intervals carry forms away. The infeed conveyor has conveyance elements (such as rollers with endless conveyor tapes or belts) mounted on a carriage pivoted at the infeed end for movement about a vertical axis, with the outfeed end is moved generally linearly by a stepper motor with a pin/slot connection to the carriage.

27 Claims, 8 Drawing Sheets

HIGH CAPACITY STACKER/SEPARATING DEVICE

BACKGROUND AND SUMMARY OF THE INVENTION

There are a number of different circumstances in the manufacture or handling of business forms when it is desirable to have a high capacity conveyance or stacking of forms. For example, the Moore 4800 Pressure Seal System, available from Moore Business Forms of Lake Forest, Ill., pressure seal mailer type business forms are produced and then delivered to an outfeed conveyor. It is desirable to have an outfeed which is large enough to accommodate a substantial number of forms (e.g. typically at least twenty inches and preferably about a two foot stack of forms, depending upon size, weight, fold type, and insert presence), and which can be unloaded while the machine is running.

A number of different stackers have been utilized in association with such systems, such as shown in U.S. Pat. No. 5,409,207 (the disclosure of which is incorporated by reference herein). Other stackers that have been utilized include a power drop-stacker that is similar to the Moore 7400 stacker in which forms are piled on a shelf until they reach a sensor that activates and lowers the shelf. A third type of stacker that has been utilized in such systems is a spring loaded stacker which utilizes a platform mounted on two rods in such a way that the unit swings down while the platform remains horizontal. However, all of these stackers have a number of disadvantages associated therewith for some circumstances, and also it may be difficult to integrate them with a simple yet effective job separator, such as a job separator disposed between the pressure sealer or other business forms manufacturing or handling equipment, and the outfeed conveyor.

According to the present invention a system, delivery mechanism, and method are provided which allow the build up of at least twenty inches of forms in a simple and reliable manner, can be unloaded as the machine is running, and may be easily integrated with an effective job separator upstream thereof.

According to one aspect of the present invention a high capacity conveyor assembly for business forms is provided. Any business form can be handled thereby, such as mailer type business forms with or without inserts, single sheet forms, forms that are unfolded or that are folded (e.g. V, Z or C folded), or in some circumstances even plain paper sheets. The assembly comprises the following elements: An infeed conveyor having a first conveyance surface and for feeding forms in a first direction. An outfeed conveyor having a second conveyance surface and for feeding forms in the first direction. A pair of nip wheels between the infeed and outfeed conveyors for receiving a business form from the infeed conveyor and directing the business form to the outfeed conveyor in the first direction, the pair of nip wheels including a top nip wheel and a bottom nip wheel with a nip between them, the bottom nip wheel having a top peripheral surface closer to the outfeed conveyor than is the nip. And a transition element between the nip and the outfeed conveyor, the transition element including a form-supporting surface lower than the bottom nip wheel top peripheral surface.

The transition element may comprise a shelf, with the form supporting surface comprising a top surface of the shelf, and of low friction material. For example, the shelf (including the top surface) may be of stainless steel, or the top surface may be of polytetrafluoroethylene or have a polytetrafluoroethylene coating. Also, a first sensor is typically provided for sensing building up forms on the transition element. A first motor powers the outfeed conveyor, and a controller controls operation of the first motor to convey forms away from the transition element when the first sensor senses a build up of forms thereon.

The first conveyance surface is typically located on a lower level than the second conveyance surface and both the first and second conveyance surfaces are substantially horizontal. A slanted guide surface on which business forms travel and are guided from the first conveyance surface to the nip, is preferably also provided. The nip wheels are preferably powered by a second motor, controlled by the controller independently of the first motor, and the upper nip wheel is spring pressed into engagement with the lower nip wheel at the nip.

The outfeed conveyor may be of a wide variety of types. For example, it may under some circumstances be a table with a pusher mechanism associated with it, or a movable backstop, or it may include rollers, wheels, ball bearings, or like conveyance elements as the second conveyance surface. Alternatively, a wide variety of powered mechanisms can be utilized such as powered rollers, wheels, ball bearings, or the like, powered rigid elements, or a wide variety of other conventional constructions. In the preferred embodiment, however, the outfeed conveyor comprises first and second rolls over which a plurality of endless conveyor belts or tapes pass, a top surface of the endless belts or tapes defining the second conveyance surface. The second conveyance surface has a first end adjacent the transition element and a second end remote from the transition element, and the second conveyance surface is at least about twenty inches long (typically at least about two feet long); that is, the substantially horizontal spacing between the first and second ends of the second conveyance surface is at least about twenty inches. A second forms-sensing sensor may be adjacent a second end of the second conveyance surface for providing input to the controller. The sensors may be of any suitable type, such as magnetic, capacitive, electromagnetic, tactile, or almost any other conventional sensor construction. Preferably, however, the sensors are optical sensors, either of the reflective type, or with an emitter on one side of the conveyor and a detector on the opposite side (i.e. a through-beam optical sensor).

The infeed conveyor can also be of a wide variety of types, such as described above with respect to the outfeed conveyor. Preferably, however, the infeed conveyor comprises a job separator conveyor powered by a third motor. Various job separator constructions that may be utilized according to the invention are shown in U.S. Pat. Nos. 5,238,164 and 5,265,731 (the disclosures of which are hereby incorporated by reference herein).

In the preferred form, the job separator and feed conveyor according to the invention may comprise powered conveyor elements powered by a third motor and mounted on a carriage having a first, infeed, end remote from the nip wheels and a second, outfeed end adjacent the nip wheels and pivotally mounted (for movement about a vertical pivot axis) near the first end thereof, and substantially linearly movable adjacent the second end thereof to pivot about the vertical pivot axis thereof. The nip wheels are particularly desirable for use in association with such a structure because the nip wheels positively grasp the forms when being conveyed in a first direction, and once they grab the forms even if the job separator conveyor starts shifting (to initiate a job separation action) the form grasped by the nip wheels will not in any way be adversely affected, ensuring proper separation, preventing re-merging of forms, and also allowing high capacity outfeed where there is plenty of space for the separated forms to lay so that they do not get mixed up as the conveyor moves.

A particular conveyor system according to the present invention, utilizing a novel infeed conveyor, also is provided comprising the following elements: A job separator infeed conveyor, powered by a first motor, and having a first conveyance surface and for feeding forms in a first direction. An outfeed conveyor having a second conveyance surface and for feeding forms in the first direction. A transition between the infeed and outfeed conveyors for transferring forms from the infeed conveyor to the outfeed conveyor wherein the first conveyance surface and the first direction are substantially horizontal. And wherein the job separator infeed conveyor comprises: at least one powered conveyor element, powered by the first motor, mounted on a carriage, and having a first, infeed, end, and a second, outfeed, end; means for pivotally mounting the carriage closer to the first end thereof than the second end thereof for pivotal movement about a first substantially vertical axis; and means for substantially linearly moving the carriage adjacent the second end thereof in a second substantially horizontal direction, substantially perpendicular to the first direction, so that the carriage pivots about the first substantially vertical axis.

The means for substantially linearly moving the carriage adjacent the second end thereof may comprise a wide variety of structures, such as one or more solenoids, one or more pneumatic or hydraulic piston/cylinder assemblies, one or more rotating screws with traveling nut structures, or a wide variety of other conventional substantially linear actuators (connected so as to accommodate the pivotal movement that ensues from the substantially linear action thereof). In the preferred form according to the invention, however, the means for substantially linearly moving the carriage adjacent the second end thereof comprises: a stepper motor having a shaft and an arm extending substantially perpendicular to the shaft; a slotted portion of the carriage adjacent the second end having an elongated slot therein; and a connector between the arm and the slot, so that rotation of the shaft is translated into substantially linear movement of the carriage slotted portion in the second direction.

The means for pivotally mounting the carriage may also comprise a wide variety of different structures, almost any conventional type of pivotal arrangement, whether located above, below, or at the sides of, the carriage being suitable. However, one particularly desirable pivotally mounting means comprises a substantially vertical shaft extending into engagement with the carriage from a position below the carriage, and suitable bearing means cooperating between the shaft and the carriage, the bearing means being of a wide variety of different types including thrust, roller, needle, or low friction stationary surface, bearings.

According to another aspect of the present invention a method of delivering forms each having a leading and a trailing edge, using a pair of powered nip wheels including an upper nip wheel and a lower nip wheel with a nip between them and positioned so that the lower nip wheel has an upper peripheral surface that is vertically above the nip, and horizontally spaced from the nip in a first direction, is provided. The method comprises the steps of: (a) Moving a business form in a first direction toward the nip wheels. (b) Grasping the business form with the nip wheels and continuing to move the form in the first direction until the trailing edge of the form moves through the nip. (c) Engaging the trailing edge of the form with the upper peripheral surface of the lower nip wheel after the form moves through the nip so that the form trailing edge continues to move in the first direction, and then downwardly, after passing through the nip, to a transition position. And (d) moving the form away from the transition position in the first direction.

Step (d) may be practiced at spaced time intervals, and in response to sensing (e.g. with an optical sensor) of the build up of forms at the transition position. A low friction surface may be provided at the transition position in which forms may be built up, and step (c) may then be practiced to move forms in sequence along the low friction surface until build up thereof is sensed. Step (b) may be practiced so as to move each form in the first direction at a slightly greater speed than the form is moved in the first direction during the practice of step (a) (or at the same speed). The business forms may be of any suitable type, but in one preferred example according to the invention are pressure sealed business forms, sealed in a pressure sealer, and step (a) may then be practiced to move forms in sequence, away from the pressure sealer.

The invention also relates to a business forms delivery mechanism per se. The delivery mechanism comprises the following elements: A pair of nip wheels for receiving a business form and directing the business form in a first direction, the pair of nip wheels including a top nip wheel and a bottom nip wheel with a nip between them, the bottom nip wheel having a top peripheral surface above the nip and downstream of the nip in the first direction; and a shelf downstream of the nip in the first direction, and including a form-supporting top surface, the shelf top surface lower than the bottom nip wheel top peripheral surface. The forms supporting surface may be of low friction material, e.g. of stainless steel (the whole shelf may be of stainless steel), or of—or coated with—Teflon®.

It is a primary object of the present invention to provide for the effective and versatile delivery and stacking of business forms, including with high capacity outfeed and/or job separation capabilities. This and other objects of the invention will become clear from an inspection of the detailed description of the invention and from the appended claims.

DETAILED DESCRIPTION OF THE DRAWINGS

Figure 1:
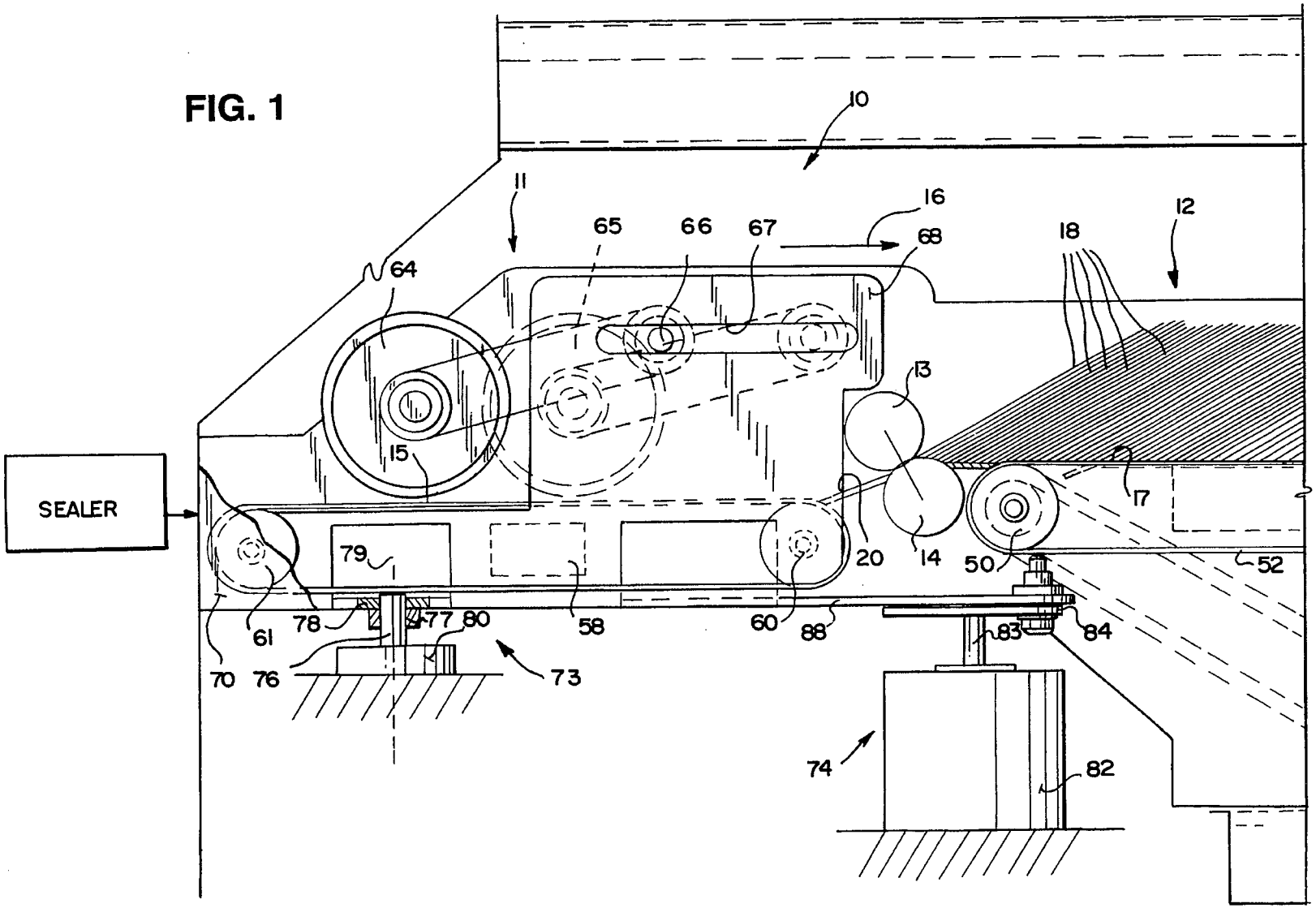
FIG. 1 is a side schematic view showing an exemplary infeed conveyor, nip wheels, and portion of an outfeed conveyor, of an exemplary conveyor assembly according to the present invention, and in schematic relationship with a pressure sealer.

A high capacity conveyor assembly according to the present invention is shown schematically at 10 in FIGS. 1 through 3, 5 and 6, having as the main components thereof an infeed conveyor 11, an outfeed conveyor 12, and a pair of nip wheels 13, 14. The infeed conveyor 11 has a first substantially horizontal conveyance surface 15 and is for feeding business forms in a first direction 16, while the outfeed conveyor 12 has a second substantially horizontally conveyance surface also for feeding forms in the direction 16. A plurality of pressure sealed mailer type business forms are shown schematically at 18 in FIGS. 1 through 3 formed in a stack which is intermittently moved in the first direction 16 along the second conveyance surface 17.

Figure 3:
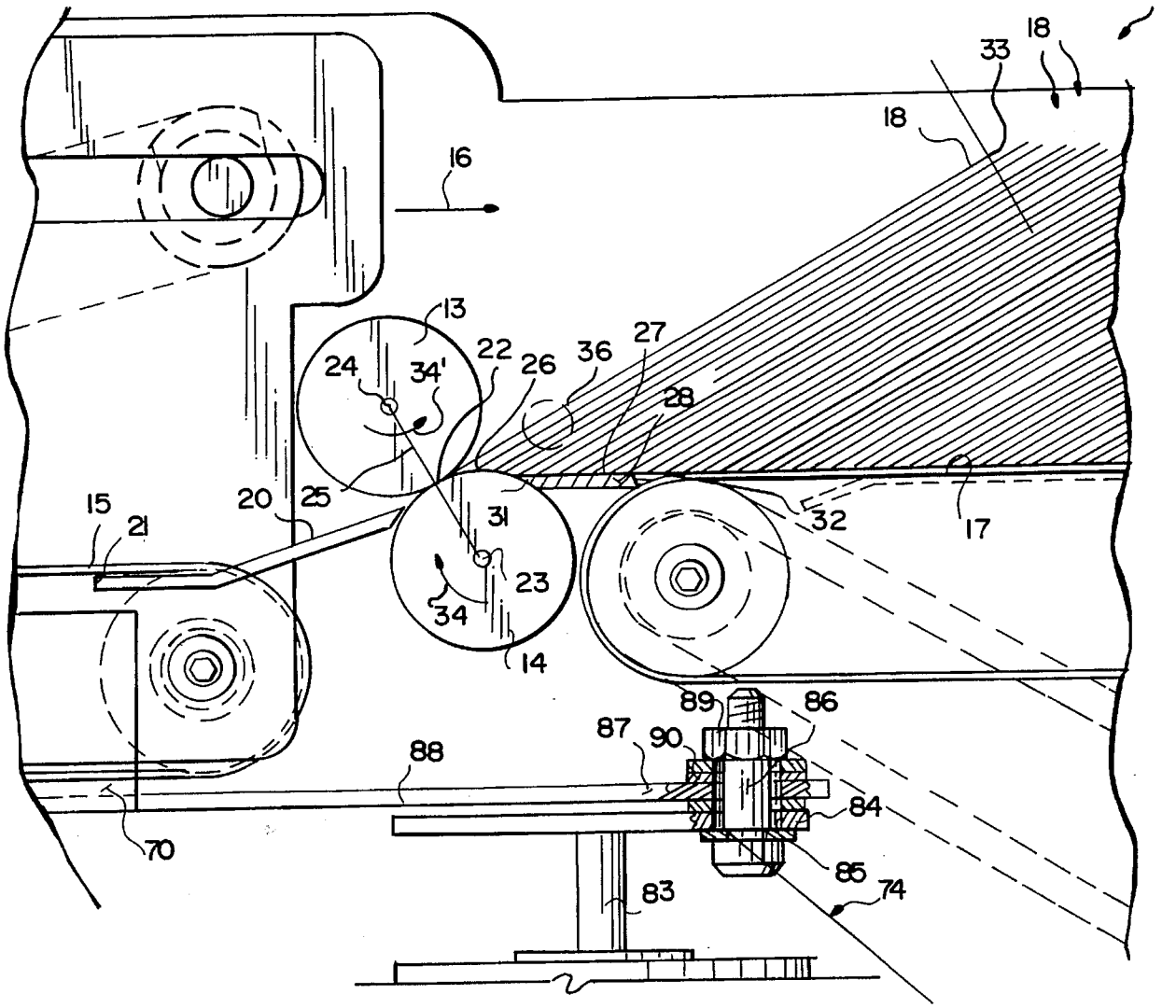
FIG. 3 is a side detailed schematic view showing the delivery of forms between the infeed and outfeed conveyors in the assembly of FIGS. 1 and 2.

As seen most clearly in FIGS. 1 and 3, the first conveyance surface 15 is lower than (at a lower vertical level than) the second surface 17, and a slanted guide surface 20 extends from a portion 21 thereof (see FIG. 3) overlapping the first conveyance surface 15 to just before the nip 22 in the direction 16. The slanted guide surface 20 may be of a low friction material, such as stainless steel, polytetrafluorethylene, or other smooth or polished material.

As seen most clearly in FIG. 3, the lower nip wheel 14 has an axis of rotation 23 which is spaced from the axis of rotation 24 of the upper nip wheel 13 in the direction 16 so that an imaginary line 25 between the axis of rotation 23, 24 is close to being perpendicular to the surface 20, and to the orientation of a business form 18 when in desired configuration in the stack illustrated in FIG. 3. This relative positioning of the nip wheels 13, 14 means that there is a top peripheral surface 26 of the bottom nip wheel 14 that is vertically above the nip 22 and closer to the outfeed conveyor 12 than the nip 22 in the direction 16. Downstream of [in the direction 16], and slightly (e.g. typically less than one-half inch) below the top peripheral surface 26 is a forms supporting surface 27 of a transition element 28. The transition element 28 provides for transition of the forms 18 between the nip 22 and the second conveyance surface 17 of the outfeed conveyor 12.

Figure 5:
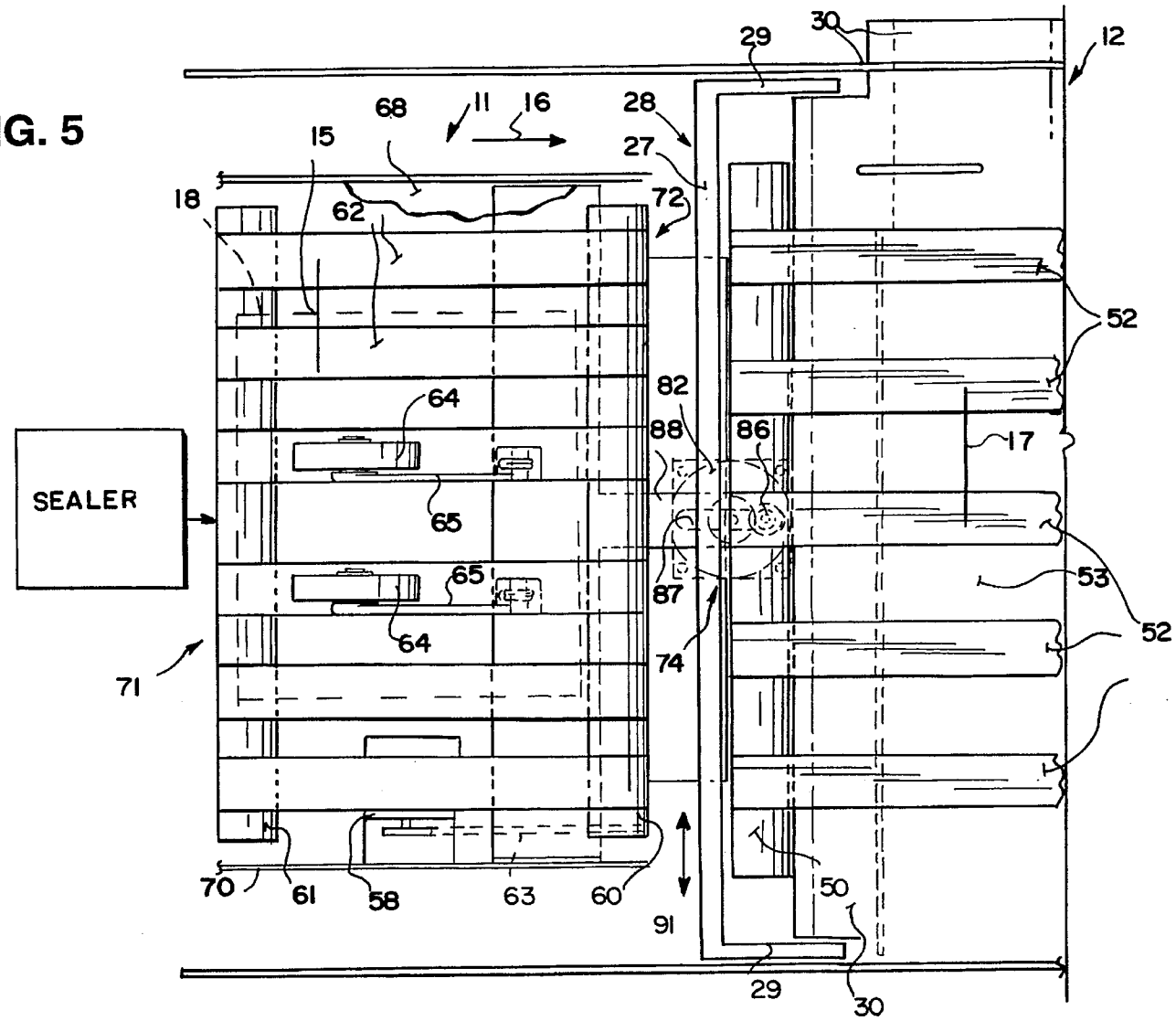
FIG. 5 is a top view of the structure of FIG. 1.
Figure 4:
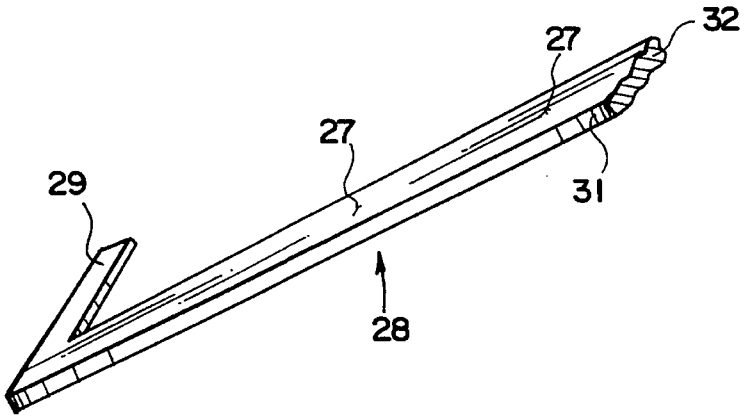
FIG. 4 is a perspective view of a portion of the exemplary shelf utilized as a transition element between the nip wheels and outfeed conveyor in the assembly of FIGS. 1 through 3.

While the transition element 28 may be of a wide variety of structures, in the preferred form illustrated in the drawings—particularly see FIGS. 3 through 5—it comprises a shelf with the form-supporting surface 27 being the top of the shelf. As seen in FIGS. 4 and 5, the shelf 28 may have mounting portions 29 thereof that mount the shelf 28 to the frame 30 of the outfeed conveyor 12. As seen in FIGS. 3 and 4, the leading and trailing edges 31, 32, respectively, may each comprise a slightly curved bevel so that the leading and trailing edges 31, 32 are as close as possible to the lower nip wheel 14 and the conveyance surface 17 without interfering with them.

The conveyance surface 27 is preferably a low friction surface. For example, the entire transition element/shelf 28 may be made of stainless steel, including the surface 27 thereof, or may be of another material and/or have a polytetrafluoroethylene coating, layer, or other configuration on the top surface 27 thereof; or other low friction materials may be utilized.

The particular configurations of and positioning of the elements 13, 14, 28, 17, as described above and as illustrated most clearly in FIGS. 1, 3, and 5, is particularly advantageous in ensuring proper conveyance of the forms. Since nip wheels inherently provide pressure at the nip 22 thereof, when the leading edge 33 (see FIG. 3 for the left-most form 18) of a form 18 enters the nip 22, it is positively grasped by the nip wheels 13, 14. If the nip wheels 13, 14 are powered—as desired (see direction of rotation arrows 34, 34' in FIG. 3), either at the same speed as or slightly greater speed than the infeed conveyor 11—the form 18 is positively conveyed generally upwardly and in the direction 16. Once the trailing edge 35 of the form 18 leaves the nip 22, it continues to be moved by the upper peripheral surface 26 of the lower nip wheel 14 in the direction 16, first upwardly and then moving downwardly slightly into engagement with the top surface 27 of the transition element 28. This not only ensures proper delivery of the forms to the outfeed conveyor 12, but maintains proper separation between the forms, and prevents re-merging of forms while allowing a buildup of forms that may be sensed.

Figure 6:
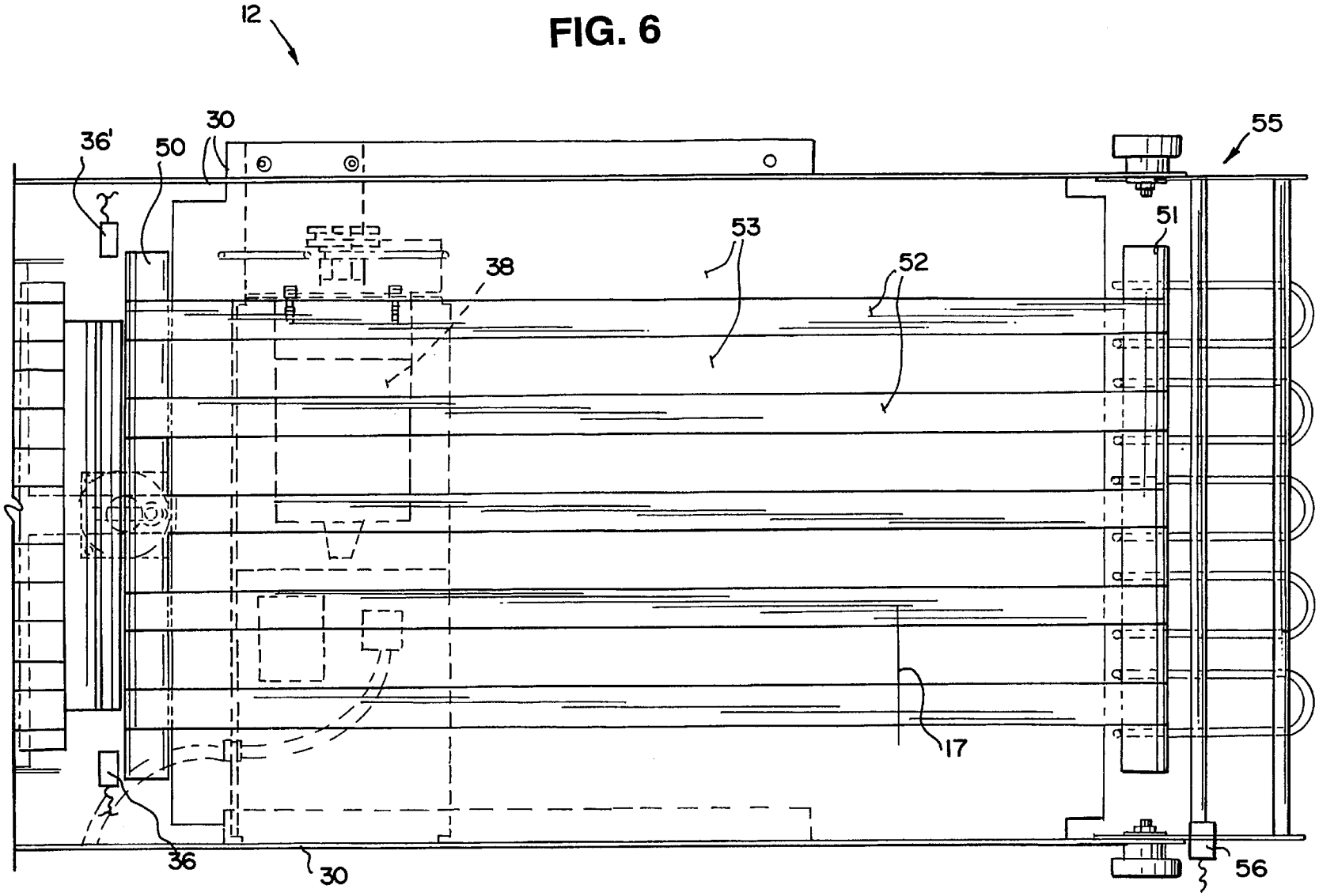
FIG. 6 is a top view of the structure of FIG. 2.
Figure 9:
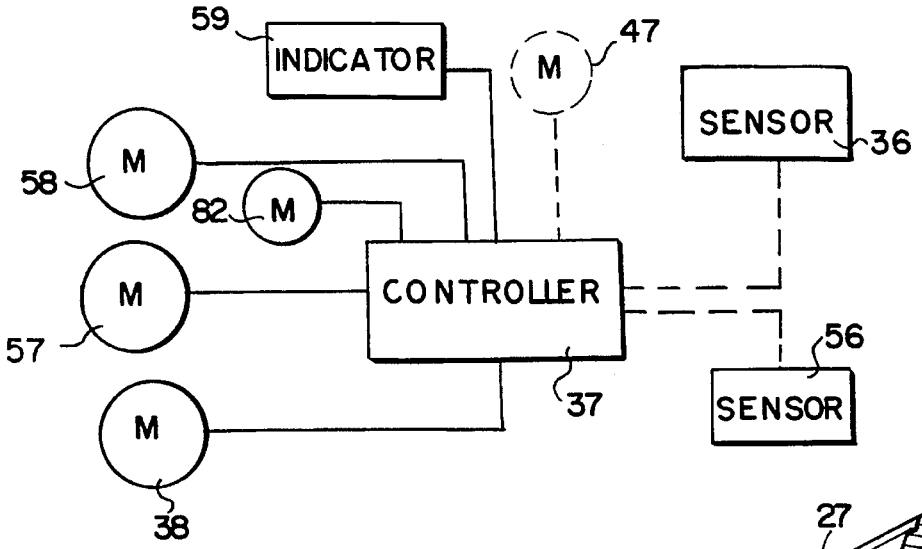
FIG. 9 is a block diagram illustrating the relationship between sensors, motors, and a controller in an exemplary embodiment according to the present invention.

A first sensor 36 (see FIGS. 3 and 6) is preferably provided for sensing the buildup of forms 18 on the transition element 28. The sensor 36 preferably has the position illustrated in FIG. 3, that is slightly above and to the right of the top peripheral surface 26 of the lower nip wheel 14 and above and slightly to the right of the leading edge 31 of the transition element 28. The sensor 36 may be of any suitable type, such as magnetic, capacitive, electrostatic, tactile, etc. Preferably it comprises either a through-beam optical sensor, or a reflective optical sensor. A through-beam type is illustrated in FIG. 6, showing the emitter (36) on one side and the detector (36') on the other. The sensor 36—through a conventional computer type controller 37 (see FIG. 9)—controls a motor 38 for powering the outfeed conveyor 12 as will be hereafter described.

Figure 11:
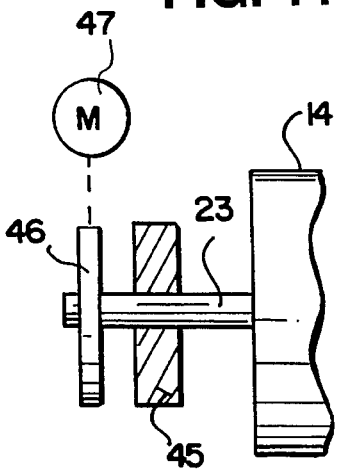
FIG. 11 is a side detailed schematic view, partly in cross section and partly in elevation, showing how the nip wheels of FIG. 10 may be powered.
Figure 10:
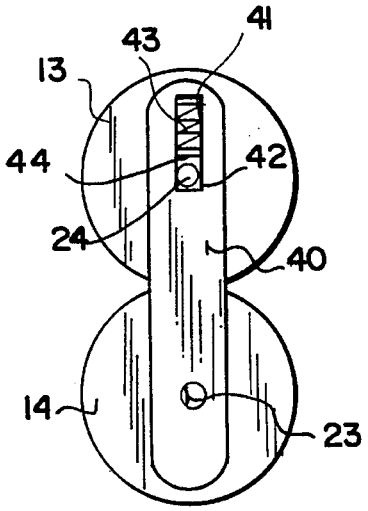
FIG. 10 is a detailed side view of the particular relationship between nip wheels that may be utilized in the structure of FIGS. 1 through 3, 5 and 6.

As earlier indicated, the nip wheels 13, 14 are preferably powered, and the nip action thereof is preferably provided by a light spring pressure. Desirable nip wheel constructions are schematically illustrated in FIGS. 10 and 11. FIG. 10 shows a metal bar 40 receiving the rotation axis-defining shaft 23 of the lower nip wheel 14, and having a slot 41 therein which receives the rotation axis-defining shaft 24 of the upper nip wheel 13. When the peripheries of the wheels 13, 14 are in engagement with each other defining the nip 22, the shaft 24 is slightly spaced from the "bottom" end 42 of the slot 41, but it is biased toward that end 42 (and toward the shaft 23) by a suitable conventional biasing mechanism, such as the coil spring 43 which engages the shaft 24 through the low friction block 44 which is guided for reciprocation within the slot 41 and conforms to the periphery of the shaft 24. A similar bar 40, etc., is provided on the other end of the wheels 13, 14.

FIG. 11 schematically illustrates one manner in which the lower nip wheel 14 can be mounted and driven. The shaft 23 thereof extends through any suitable conventional bearing 45, and has a pulley or sprocket or gear 46 at the end thereof, which is operatively connected (e.g. by a pulley, chain, or gear or gear train) to a conventional motor (e.g. electric motor) 47.

In the broadest aspects of the invention, the outfeed conveyor 12 may comprise any suitable conveyor arrangement, and the second conveyance surface 17 may be formed by rollers, ball bearings, a low friction surface, or a variety of structures which cooperate with pushers, movable backstops, drive blocks or chains, or the like. However, in the preferred embodiment according to the present invention the outfeed conveyor 12 comprises first and second rollers 50, 51 (e.g. see FIG. 2) with a plurality of endless loop conveyor belts or tapes extending therearound, the belts or tapes 52 above the rollers 50, 51 defining the second conveyance surface 17. As seen in FIG. 5, a supporting table structure 53 may be stationarily mounted beneath the upper portions of the tapes or belts 52, so that the table 53 also in part forms the second conveyance surface 17. In the embodiment illustrated in the drawings, the first roller 50 is powered by the motor 38, such as through a belt and pulley arrangement illustrated in dotted line at 54 in FIG. 2.

Figure 2:
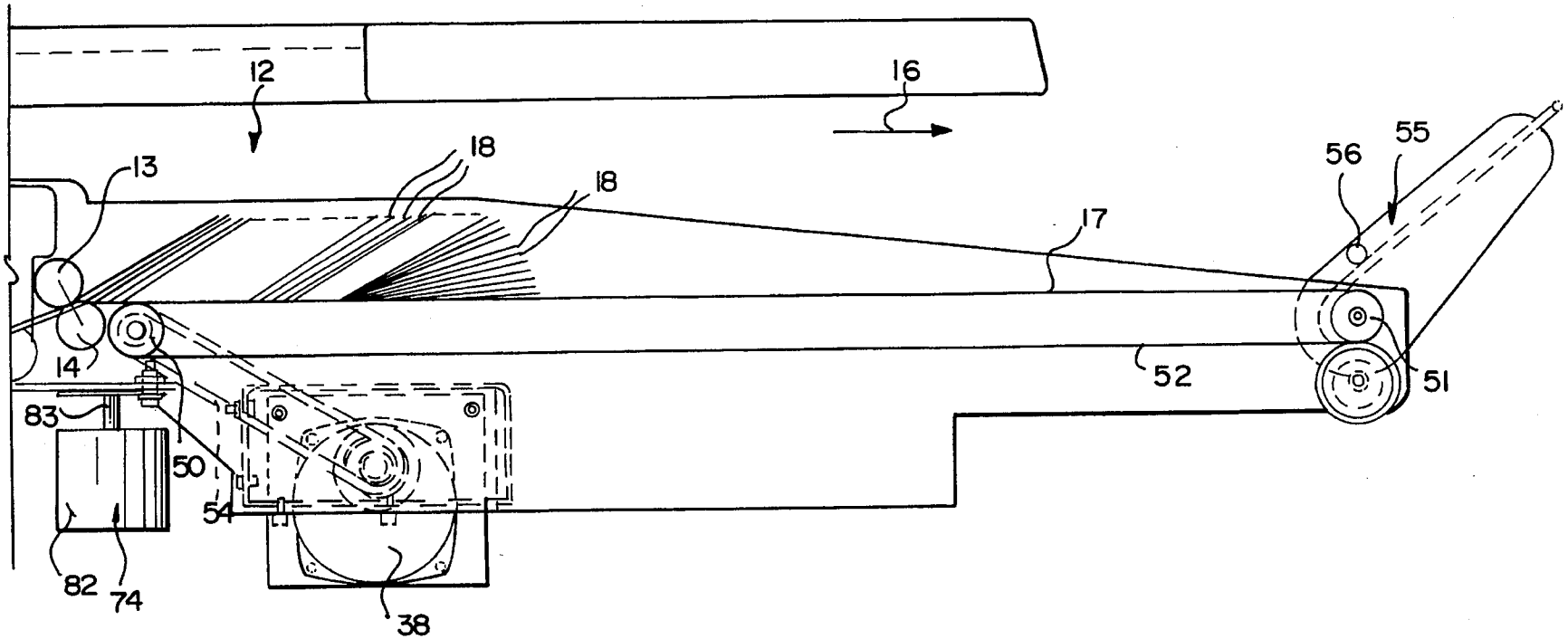
FIG. 2 is a view like that of FIG. 1 showing the nip wheels and the entire exemplary high capacity outfeed conveyor.

The conveyance surface 17—from the first end thereof adjacent the transition element 28 to the opposite end thereof—shown generally at 55 in FIGS. 2 and 6—is preferably at least about twenty inches long, and preferably about two feet long or more. The motor 38 is operated intermittently under the control of the controller 37 and in response to sensing of the buildup of forms 18 on the transition element 28 by the sensor 36. No backstop is required for use in association with the conveyor 12, although a simple stop that merely rests on the belts 52 may be utilized if desired as the forms 18 simply sit on the belts 52 themselves. The operator can unload the forms even while the machine is running. Desirably there is a second sensor 56—see FIG. 2—such as a reflective or through-beam optical sensor, adjacent the second end 55 to sense when the forms 18 have built up in a stack that completely fills the conveyor 12. The sensor 56—as illustrated schematically in FIG. 9—provides input to the controller 37, and the controller 37 can stop operation of the motor 38, the motor 57 (which powers the pressure sealer—such as a Moore conventional 4800 Pressure Sealer System illustrated schematically in FIGS. 1 and 2—and a motor 58 for the infeed conveyor 11, as will be hereinafter described). Additionally or alternatively the sensor 56 may provide data to the controller 37 so that the controller causes an indicator 59 (such as a light, bell, and/or other indicator) to be activated advising the machine operator that it is time to empty the outfeed conveyor 12.

While the configuration illustrated in the drawings is preferred, the outfeed conveyor 12 may also be associated with a right angle turn just ahead of it to accept forms from a Moore 4800 system.

The infeed conveyor 11 may be a simple conveyor of any suitable type (such as described earlier with respect to the outfeed conveyor 12), but like the outfeed conveyor 12 (see FIG. 5) preferably comprises a pair of rollers 60, 61 with a plurality of endless belts or tapes 62 extending around them, with the top surfaces of the belts 62 defining a first conveyance surface 15. As illustrated schematically in FIG. 5, the motor 58 may be connected—as through a chain, belt, or gear—illustrated schematically at 63 in FIG. 5—to the roller 60 to power it for rotation about a horizontal axis (parallel to the axes of rotation of the rollers 50, 51 and the nip wheels 13, 14). Conventional hold-down wheels, bars, or other elements may also be associated with the infeed conveyor 10 for-holding the business forms flat and on the belt 62. For example, the hold-down mechanisms may comprise a pair of wheels 64 mounted on arms 65, which arms 65 (see FIGS. 1 and 5) are mounted to pins 66 which may slide in an elongated slot or slots 67 and a support mechanism or mechanisms 68 so that the hold-down wheels 64 are adjustable along the first conveyance surface 15. The hold-down wheels 64 may hold the forms 18 flat by gravity, or they may be spring pressed.

In the preferred embodiment according to the present invention, the infeed conveyor 11 also comprises a job separator. This is preferably accomplished according to the present invention by mounting the entire conveyor structures 60, 61, 62, 58 on a carriage, illustrated schematically by reference numeral 70 in FIGS. 1 and 5. The conveyor 11, and the carriage 70, include an infeed end 71 and an outfeed end 72 downstream of the infeed end 71 in the first direction 16. Job separation capability is provided by utilizing means for pivotally mounting the carriage, illustrated schematically at 73 in FIGS. 1, 7 and 8, and means for substantially linearly moving the carriage—illustrated schematically at 74 in the drawings.

The means for pivotally mounting the carriage 70 may comprise any suitable structure mounted either above, below, or on the sides of the carriage 70. For example, a roller thrust bearing may be mounted between the bottom surface of the carriage 70 and a stationary surface, or a shaft mounting can be provided containing two or more ball bearings, needle bearings, or roller bearings, bronze or plastic bushings, or similar bearing devices. Between the top of the mounting and the bottom of the carriage some sort of thrust bearing may be provided to take the weight of the carriage, or the shaft could be located in the side frames for the structure and the bearings mounted on the underside of the carriage 70 with a thrust bearing between the bottom of the bearing mounting and the surface from which the shaft protrudes.

In the embodiment illustrated in the drawings, the pivot means comprises a substantially vertical shaft 76 (see FIG. 1) having a thrust bearing 77 which assists in supporting the weight of the platform 70, and having a bushing 78—which may be a ball bearing, roller bearing, needle bearing, bronze or plastic sleeve, or almost any other suitable type of bushing or bearing—which allows pivotal action of the shaft 76 with respect to the platform 70 about a substantially vertical axis 79. The other end of the shaft 76 may be stationarily mounted in the support structure 80. At the opposite end 72 of the infeed conveyor/job separator 11, the carriage 70 can be mounted by the mechanism 74.

The linearly moving mechanism 74 may also be of any suitable type. For instance, it can comprise one or more solenoids, one or more pneumatic or hydraulic piston/cylinder arrangements, one or more rotating screws with traveling nuts, or any other suitable type of linear actuating structure. In the preferred form illustrated in the drawings, however, the structure 74 includes a stepper motor 82 which has a shaft 83 and with an arm 84 (which may be an apertured disc) connected to the shaft 83. In the arm 84 (see FIGS. 3 and 1 in particular) is an opening 85 which receives a connector 86. Opening 85 is off center from the shaft 83 in the arm 84. The connector 86 also passes through a slot 87 in a slotted portion—extension 88—of the carriage 70 (particularly the lower surface thereof). The connector 86 may be fastened in place, as with the nut 89 and washers 90 (see FIG. 3). The connector 86 thus causes the slotted portion 88 of the platform 70 to be moved substantially linearly in a second horizontal direction 91 (see FIG. 5) substantially perpendicular to the first direction 16 because of the connector 86 engaging the slot 87 walls as the stepper motor 82 rotates. There is enough looseness in the connection between the connector 86 and the slot 87 to allow the parts to move with respect to each other. The stepper motor 82 will rotate between 180° positions in response to controls from the controller 37, shifting between the positions illustrated in FIGS. 7 and 8 so as to separate the forms 18 into different jobs.

Figure 7:
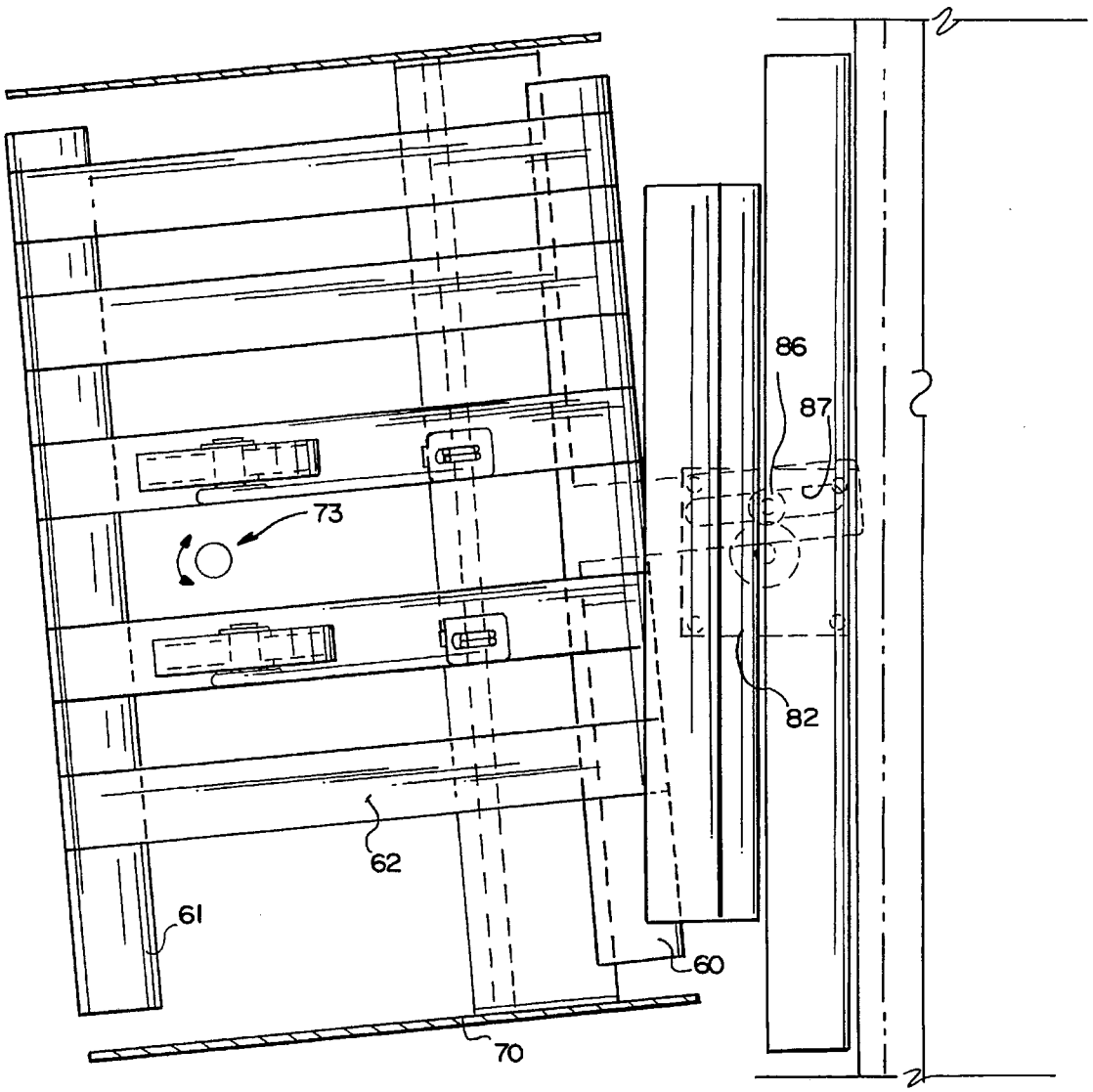
FIGS. 7 and 8 are top schematic views, with many of the details and overlying structures removed for clarity of illustration, showing how an exemplary job separator shifting action may take place utilizing the particular infeed conveyor of FIGS. 1 and 4.
Figure 8:
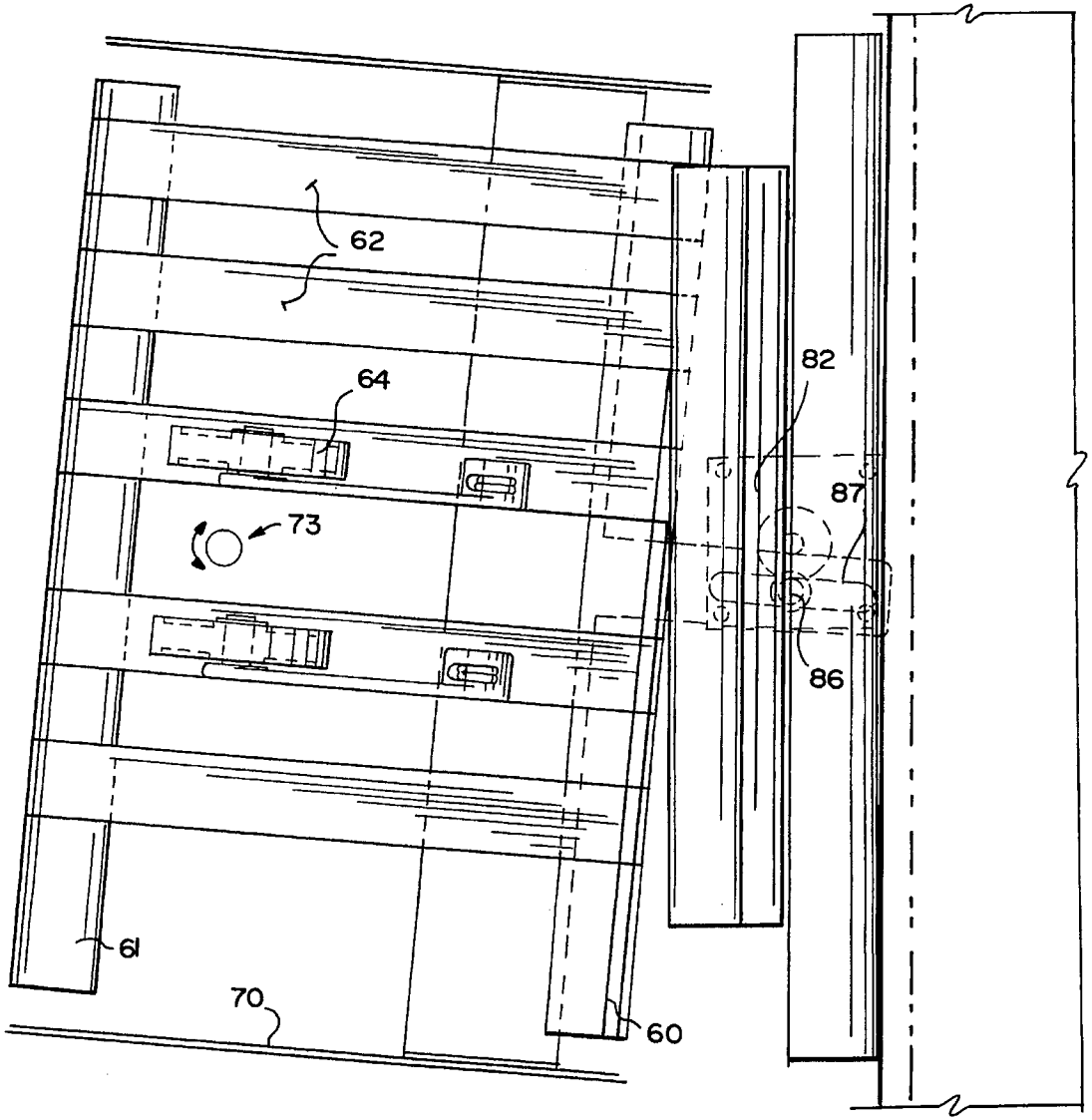

The provision of the nip wheels 13, 14 is ideally suited for cooperation with the infeed conveyor/job separator 11 heretofore described because once a form 18 enters the nip wheels 13, 14 shifting can take place between the positions illustrated in FIGS. 7 and 8 without an adverse action on the form 18—that is the form 18 will be delivered to the correct (previous) group. Also, the nip wheels 13, 14 provide an elongated area for positively grasping the forms, so that again they are not particularly susceptible to or adversely affected by the shifting action.

While the nip wheels 13, 14 are preferred as a transition mechanism between the infeed conveyor/job separator 11 and some sort of an outfeed mechanism (such as the outfeed conveyor 12), in the broadest aspects of the job separator aspect of the instant invention, other transition elements could be utilized. For example, a simple gap could be provided between the infeed and outfeed elements, sliding platforms per se (whether slanted or horizontal), guide rollers, or ball bearing type arrangements such as illustrated in U.S. Pat. Nos. 5,238,164 and 5,265,731, or any other suitable structures could be utilized.

It will thus be seen that according to the present invention a relatively simple yet effective mechanism for transporting business forms from a business forms manufacturing or handling structure to an outfeed mechanism in which the business forms may be stacked and/or handled, is provided, as well as a job separator that may be utilized therewith, or with similar structures. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures, assemblies, and methods.

What is claimed is:

1. A high capacity conveyor assembly for business forms, comprising:

an infeed conveyor having a first conveyance surface and for feeding forms in a first direction;

an outfeed conveyor having a second conveyance surface and for feeding forms in the first direction;

a pair of nip wheels between said infeed and outfeed conveyors for receiving a business form from said infeed conveyor and directing the business form to said outfeed conveyor in the first direction, said pair of nip wheels including a top nip wheel and a bottom nip wheel with a nip between them, said bottom nip wheel having a top peripheral surface closer to said outfeed conveyor than is said nip; and a transition element between said nip and said outfeed conveyor, said transition element including a form-supporting surface lower than said bottom nip wheel top peripheral surface.

2. A conveyor assembly as recited in claim 1 wherein said transition element comprises a shelf, and wherein said form supporting surface comprises a top surface of said shelf, and is of low friction material.

3. A conveyor assembly as recited in claim 2 wherein said shelf, including said top surface thereof, is of stainless steel.

4. A conveyor assembly as recited in claim 2 wherein said top surface of said shelf has a polytetrafluoroethylene coating or is of polytetrafluoroethylene.

5. A conveyor assembly as recited in claim 1 further comprising a first sensor for sensing buildup of forms on said transition element, a first motor for powering said outfeed conveyor, and a controller, said controller operating said first motor to convey forms away from said transition element when said first sensor senses buildup of forms on said transition element.

6. A conveyor assembly as recited in claim 5 wherein said first conveyance surface is located on a lower level than said second conveyance surface and both said first and second conveyance surfaces are substantially horizontal; and further comprising a slanted guide surface on which a business form travels and is guided from said first conveyance surface to said nip.

7. A conveyor assembly as recited in claim 6 wherein said nip wheels are powered by a second motor, and controlled by said controller independently of said first motor.

8. A conveyor assembly as recited in claim 7 wherein said upper nip wheel is spring pressed into engagement with said lower nip wheel at said nip.

9. A conveyor assembly as recited in claim 6 wherein said outfeed conveyor comprises first and second rolls over which a plurality of endless conveyor belts or tapes pass, a top surface of said endless belts or tapes defining said second conveyance surface; said second conveyance surface having a first end adjacent said transition element, and a second end remote from said transition element; and wherein said second conveyance surface is at least about twenty inches long, the substantially horizontal spacing between said first and second ends of said second conveyance surface being at least about twenty inches.

10. A conveyor assembly as recited in claim 9 further comprising a second forms-sensing sensor adjacent said second end of said second conveyance surface for providing input to said controller.

11. A conveyor assembly as recited in claim 1 wherein said infeed conveyor comprises a job separator conveyor powered by a third motor.

12. A conveyor assembly as recited in claim 11 wherein said first conveyance surface and said first direction are substantially horizontal; and wherein said job separator infeed conveyor comprises: powered conveyor elements, powered by said third motor, mounted on a carriage, and having a first, infeed, end remote from said nip wheels, and a second, outfeed, end adjacent said nip wheels; means for pivotally mounting said carriage closer to said first end thereof than said second end thereof for pivotal movement about a first substantially vertical axis; and means for substantially linearly moving said carriage adjacent said second end thereof in a second substantially horizontal direction, substantially perpendicular to the first direction, so that said carriage pivots about said first substantially vertical axis.

13. A conveyor assembly as recited in claim 12 wherein said means for substantially linearly moving said carriage adjacent said second end thereof comprises: a stepper motor having a shaft and an arm extending substantially perpendicular to said shaft; a slotted portion of said carriage adjacent said second end having an elongated slot therein; and a connector between said arm and said slot, so that rotation of said shaft is translated into substantially linear movement of said carriage slotted portion in the second direction.

14. A conveyor assembly as recited in claim 12 wherein said means for pivotally mounting said carriage comprises a substantially vertical shaft extending into engagement with said carriage from a position below said carriage, and bearing means cooperating between said shaft and carriage.

15. A conveyor assembly as recited in claim 12 wherein said powered conveyor elements comprise a pair of rolls and a plurality of endless conveyor tapes or belts disposed around said rolls, at least one of said rolls powered by said third motor; and wherein a top surface of said endless tapes or belts defines said first conveyance surface.

16. A conveyor assembly as recited in claim 1 wherein said first conveyance surface is located on a lower level than said second conveyance surface and both said first and second conveyance surfaces are substantially horizontal; and further comprising a slanted guide surface on which a business form travels and is guided from said first conveyance surface to said nip.

17. A conveyor assembly as recited in claim 16 wherein said nip wheels are powered.

18. A conveyor assembly as recited in claim 17 wherein said upper nip wheel is spring pressed into engagement with said lower nip wheel at said nip.

19. A conveyor assembly for business forms, comprising:

a job separator infeed conveyor, powered by a first motor, and having a first conveyance surface and for feeding forms in a first direction;

an outfeed conveyor having a second conveyance surface and for feeding forms in the first direction;

a transition between said infeed and outfeed conveyors for transferring forms from said infeed conveyor to said outfeed conveyor;

wherein said first conveyance surface and said first direction are substantially horizontal; and wherein said job separator infeed conveyor comprises: at least one powered conveyor element, powered by said first motor, mounted on a carriage, and having a first, infeed, end, and a second, outfeed, end; means for pivotally mounting said carriage closer to said first end thereof than said second end thereof for pivotal movement about a first substantially vertical axis; and means for substantially linearly moving said carriage adjacent said second end thereof in a second substantially horizontal direction, substantially perpendicular to the first direction, so that said carriage pivots about said first substantially vertical axis.

20. A conveyor assembly as recited in claim 19 wherein said means for substantially linearly moving said carriage adjacent said second end thereof comprises: a stepper motor having a shaft and an arm extending substantially perpendicular to said shaft; a slotted portion of said carriage adjacent said second end having an elongated slot therein; and a connector between said arm and said slot, so that rotation of said shaft is translated into substantially linear movement of said carriage slotted portion in the second direction.

21. A conveyor assembly as recited in claim 19 wherein said means for pivotally mounting said carriage comprises a substantially vertical shaft extending into engagement with said carriage from a position below said carriage, and bearing means cooperating between said shaft and carriage.

22. A conveyor assembly as recited in claim 19 wherein said at least one powered conveyor element comprises a pair of rolls and a plurality of endless conveyor tapes or belts disposed around said rolls, at least one of said rolls powered by said first motor; and wherein a top surface of said endless tapes or belts defines said first conveyance surface.

23. A method of delivering business forms, each having a leading and trailing edge, using a pair of powered nip wheels including an upper nip wheel and a lower nip wheel with a nip between them and positioned so that the lower nip wheel has an upper peripheral surface that is vertically above the nip, and horizontally spaced from the nip in a first direction, said method comprising the steps of:

(a) moving a business form in the first direction toward the nip wheels;

(b) grasping the business form with the nip wheels and continuing to move the form in the first direction until the trailing edge of the form moves through the nip;

(c) engaging the trailing edge of the form with the upper peripheral surface of the lower nip wheel after the form moves through the nip so that the form trailing edge continues to move in the first direction, and then downwardly, after passing through the nip, to a transition position; and (d) moving the form away from the transition position in the first direction.

24. A method as recited in claim 23 wherein step (d) is practiced at spaced time intervals, and in response to sensing of the buildup of forms at the transition position.

25. A method as recited in claim 24 wherein a low friction surface is provided at the transition position on which forms may build up; and wherein step (c) is practiced to move forms in sequence along the low friction surface until buildup thereof is sensed.

26. A method as recited in claim 23 wherein step (b) is practiced so as to move the form in the first direction at a slightly greater speed than the form is moved in the first direction during the practice of step (a).

27. A method as recited in claim 23 wherein the business forms are pressure sealed business forms, sealed in a pressure sealer; and wherein step (a) is practiced to move forms, in sequence, away from the pressure sealer.

* * * * *